US007223159B2

(12) United States Patent
Tschudin et al.

(10) Patent No.: US 7,223,159 B2
(45) Date of Patent: May 29, 2007

(54) CENTERLESS CYLINDRICAL GRINDING MACHINE

(75) Inventors: Urs Tschudin, Bachtelenstrasse 79, 2540 Grenchen (CH); Libor Sedlacek, Grenchen (CH)

(73) Assignee: Urs Tschudin, Grenchen (CH)

( * ) Notice: Subject to any disclaimer, the term of this patent is extended or adjusted under 35 U.S.C. 154(b) by 0 days.

(21) Appl. No.: 10/415,803

(22) PCT Filed: Sep. 3, 2001

(86) PCT No.: PCT/CH01/00528

§ 371 (c)(1),
(2), (4) Date: Sep. 26, 2003

(87) PCT Pub. No.: WO02/36305

PCT Pub. Date: May 10, 2002

(65) Prior Publication Data

US 2004/0048551 A1 Mar. 11, 2004

(30) Foreign Application Priority Data

Nov. 3, 2000 (CH) ..... 2157/00

(51) Int. Cl.
*B24B 7/00* (2006.01)
*B24B 41/06* (2006.01)

(52) U.S. Cl. ..... 451/182; 451/200; 451/210; 451/407

(58) Field of Classification Search ..... 451/182, 451/190, 194, 197, 199, 200, 209, 210
See application file for complete search history.

(56) References Cited

U.S. PATENT DOCUMENTS 1,872,405 A * 8/1932 Caster ..... 451/244
2,127,210 A * 8/1938 Dunbar ..... 451/199
4,507,896 A * 4/1985 Smith ..... 451/26

(Continued)

FOREIGN PATENT DOCUMENTS

DE 197 53 797 A 6/1999

(Continued)

OTHER PUBLICATIONS

Schaudt Mikrosa BWF: "die Kronos Baureihe" 'Online! XP002184205.

(Continued)

*Primary Examiner*—M. Rachuba
(74) *Attorney, Agent, or Firm*—Venable LLP

(57) ABSTRACT

A centerless cylindrical grinding machine, for through-feed and in-feed grinding of various workpieces (8), has a first driven positioning axis $X_S$ for a grinding spindle head (2) with a grinding wheel (1) and a second driven positioning axis $X_R$, running parallel to the positioning axis $X_S$, for a regulating spindle head (4), with a regulating wheel (3). The positioning axes $X_S$ and $X_R$ are arranged perpendicular to the rotation axes (5, 6) or the grinding wheel (1) and the regulating wheel (3). A workpiece support (7) on a carriage (12) and an inner- or outer-acting wheel-true device (9) are arranged between the grinding spindle head (2) and the regulating spindle head (4). During operation, the grinding spindle head (2), the regulating spindle head (4), the workpiece support (7) and the wheel-true device (9) are located within a safety housing (15). The carriage (12) may be adjusted along a driven positioning axis $Y_W$ which runs at right angles to the positioning axes $X_S$ and $X_R$, along a carriage track (13) and may be moved to a position outside the safety housing (15). The invention has the advantages that the machine is not just a simpler and therefore cheaper, but is also more reliable in operation and permits easy retooling.

10 Claims, 10 Drawing Sheets

U.S. PATENT DOCUMENTS 5,169,223 A * 12/1992 Suzuki et al. ..... 312/330.1
5,439,431 A * 8/1995 Hessbruggen et al. ..... 483/14
5,613,899 A * 3/1997 Weiss et al. ..... 451/245
5,704,884 A * 1/1998 Uemura et al. ..... 483/3
5,741,175 A * 4/1998 Voege ..... 451/455
5,766,057 A * 6/1998 Maack ..... 451/21
5,897,430 A * 4/1999 Haller ..... 451/451
6,312,318 B1 * 11/2001 Mushardt et al. ..... 451/49
6,568,885 B2 * 5/2003 Green ..... 409/134
6,569,000 B1 * 5/2003 Mushardt et al. ..... 451/72
6,749,495 B2 * 6/2004 Grund et al. ..... 451/451

FOREIGN PATENT DOCUMENTS

EP 0 449 767 A 10/1991
GB 1 216 535 A 12/1970
GB 2 206 299 A 1/1989
GB 2206299 A * 1/1989

OTHER PUBLICATIONS

Douglas Curtis CO,: "Universal Centerless Grinder" 'Online! XP002184206.

* cited by examiner

CENTERLESS CYLINDRICAL GRINDING MACHINE

CROSS-REFERENCE TO RELATED APPLICATIONS

This application is a 371 National Stage Application of PCT/CH01/00528, filed Sep. 3, 2001, which claims priority to Swiss Patent Document CH2157/00, filed Nov. 3, 2000.

BACKGROUND OF THE INVENTION

1. Field of the Invention

The invention relates to a centreless cylindrical grinding machine for through-feed and in-feed grinding of various workpieces. Instead of the terms through-feed and in-feed grinding other terms such as longitudinal grinding and traverse grinding are also used in the literature.

2. Description to Related Art

Centreless cylindrical grinding machines differ from the usual cylindrical grinding methods in that the workpiece to be processed is not clamped positively in the machine or a device, but rests loosely on a support (workpiece support). Centreless grinding enables higher manufacturing precision and higher productivity compared to other cylindrical grinding methods.

Current construction of centreless cylindrical grinding machines usually have a grinding spindle head driven in an axis ($X_S$) with a grinding wheel a well as a regulating wheel spindle head with a regulating wheel likewise driven in an axis ($X_R$). Fixed solidly on the machine bed between both spindle heads is the workpiece support or a bearing block serving the same purpose. Wheel-truing attachments for the grinding wheel and the regulating wheel are as a rule attached externally and can be moved by other driven axes (X' and Y' as well as X" and Y") relative to the respective spindle heads. The drawback to this construction is that there is a large number—as many as six!—of driven positioning axes, making these machines considerably more expensive.

EP-0 674 970 describes a centreless cylindrical grinding machine, in particular used for manufacturing valve rods and the like. The machine is operated in through-feed mode, since the regulating wheel is slightly inclined compared to the grinding wheel. The machine has a fixed workpiece support in the form of a plate with an angled bearing surface as well as motor-adjustable limit stops for positioning the workpiece arranged on both sides. The limit stops can be positioned in a direction parallel to the rotating axis of the grinding wheel. The workpiece support and the grinding spindle head and the regulating spindle head are not located inside a safety housing. Since the workpiece support is arranged fixed, there is also no possibility of moving the workpiece support for the purpose of operating from the danger zone of the grinding and regulating wheel.

GB-2 206 299 describes a centreless cylindrical grinding machine in which two workpiece supports are arranged on a shuttle which in turn glides on a carriage track. The carriage is not driven, but can be moved for loading the workpieces or for unloading same on one or the other side, such that at least one of the workpiece supports comes to rest fully beyond the processing zone between the grinding and the regulating wheel. The carriage with the workpiece support serves only to pick up the workpieces, carries no wheel-truing attachments and structurally is not designed to pick up wheel-truing attachments. The grinding and the regulating wheel are arranged in a work station and there are also several partial regulating wheels present. The partial regulating wheels seem to always come into use at the same time.

DE 1 994 0687 describes in FIG. 8 a grinding machine for centreless grinding of workpieces with a carriage, located on which is a workpiece support and to which dressers are also fastened. The carriage is driven and (again with the aid of the abovementioned axis directions) and can be moved in Y direction, while the grinding and the regulating wheel can be moved in $X_S$ or $X_R$ direction respectively. Through this arrangement the number of driven positioning axes is reduced, without any loss in functionality as compared to 4-axis or even 6-axis driven machines. Furthermore, with this machine type the rotating axis of the grinding wheel is set obliquely to a longitudinal central axis running in Y direction.

In this machine type the workpiece support is moved into a position next to the grinding and the regulating wheel during a truing procedure, but even then remains in the immediate vicinity of same and there are no separating or safety means which reliably protect the operator from accidental contact with the grinding wheel or the regulating wheel while a workpiece is being changed. The workpiece support can thus not be fully removed for operating from the danger zone of grinding wheel and regulating wheel. The dressers attached to the carriage in this machine can only be used in an inner-acting manner (inner-acting here means that they are put to use in the region of the workpiece support, thus essentially between the grinding and the regulating wheel). With regard to protection and accessibility during change of dressers essentially the same disadvantages arise as during exchange of workpieces.

More recent machines are often fully contained, thus guaranteeing a high level of safety. One of the manufacturers for example is the firm SCHAUDT MIKROSA BWF in Leipzig, with the machine type KRONOS S. The firm DOUGLAS CURTIS LTD in Colchester, Essex is manufacturer of another centreless cylindrical grinding machine of more recent construction of the type CURTIS UCG [Universal Centerless Grinder]. Information on both firms and machine types can be accessed via the Internet. With the abovementioned machines the moving parts are always arranged completely inside a full housing.

SUMMARY OF THE INVENTION

The object of the invention is to provide a centreless cylindrical grinding machine for through-feed and in-feed grinding of various workpieces, which operates with a minimal number of driven positioning axes and can be operated risk-free by an operator when manipulating in the vicinity of the workpiece support, such as for example setting down a new workpiece or placing or changing parts for carrying out a truing procedure. Furthermore, the means for truing the grinding and the regulating wheel should be as flexible as possible.

The solution is that in a machine according to the present invention with driven positioning axes $X_S$ (or $U_S$ respectively) and $X_R$ for shifting the grinding spindle head and the regulating spindle head and another driven positioning axis $Y_W$ running at right angles to the axis $X_R$ for a carriage with a workpiece support on a carriage track, the carriage on the carriage track can be moved into a position lying beyond (outside) a safety housing and the carriage can be provided selectively with an inner- or an outer-acting wheel-truing device.

A fundamental advantage to this solution is that centreless cylindrical grinding machines can be manufactured more cost-effectively due to the minimal number of driven positioning axes (three!) as compared to conventional machines of this type with up to six driven positioning axes. All the same the extent of functionality remains in full.

A substantial advantage here is that any handling by the operator in the vicinity of the workpiece support, such as for example setting down a new workpiece or placing or changing parts for performing a truing procedure, is not only completely risk-free, but can also be performed with substantially improved accessibility outside the safety housing.

An added advantage here is the flexibility, which is achieved by the carriage being fitted selectively with inner- (in the region of the workpiece support) or outer-acting wheel-truing attachments.

The drive of the carriage on the carriage track can also be configured such that an oscillating movement of the carriage can take place. This can lead to improved roughness values of the ground surfaces.

A centreless cylindrical grinding machine according to the present invention can also be constructed such that the grinding wheel consists of several partial grinding wheels arranged successively on the rotating axis and the regulating wheel consists of several partial regulating wheels arranged successively on the rotating axis. This allows with a first partial grinding wheel and a first partial regulating wheel a first grinding operation to be performed, then the carriage with the workpiece support is shifted into another position and with a second partial grinding wheel and a second partial regulating wheel a second grinding operation can be carried out. Even more partial grinding wheels and partial regulating wheels can be provided.

The advantage here is that several grinding operations can be carried out without time-consuming loading, unloading and changing operations for one workpiece.

BRIEF DESCRIPTION OF THE SEVERAL VIEWS OF THE DRAWINGS

An embodiment of the invention will be explained in greater detail hereinbelow with reference to diagrams, in which.

DETAILED DESCRIPTION OF THE INVENTION

Figure 1:
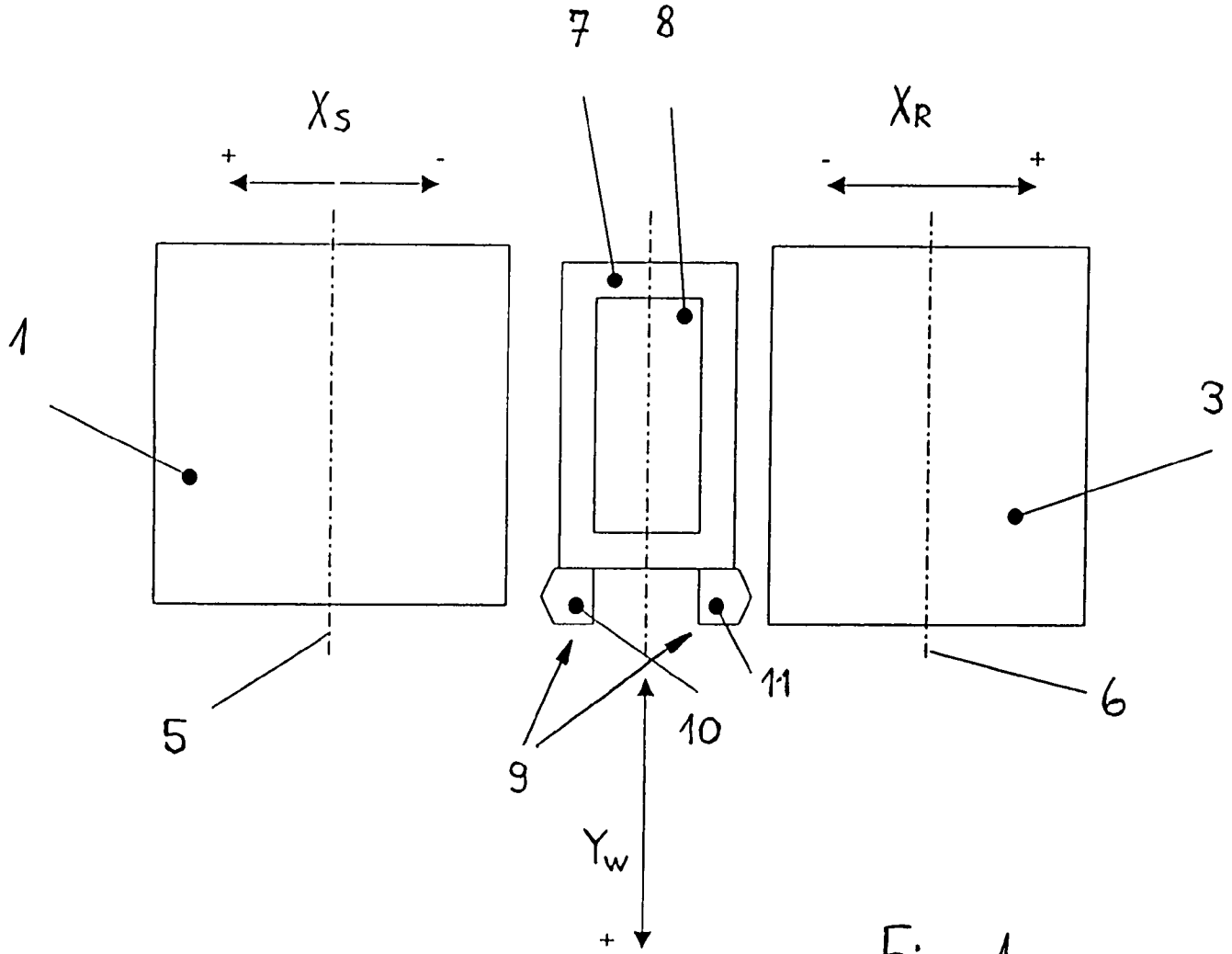
FIG. 1 is a diagram of the arrangement of the positioning axes as well as the workpiece support, the grinding wheel and the regulating wheel and inner-acting dressers.
Figure 1A:
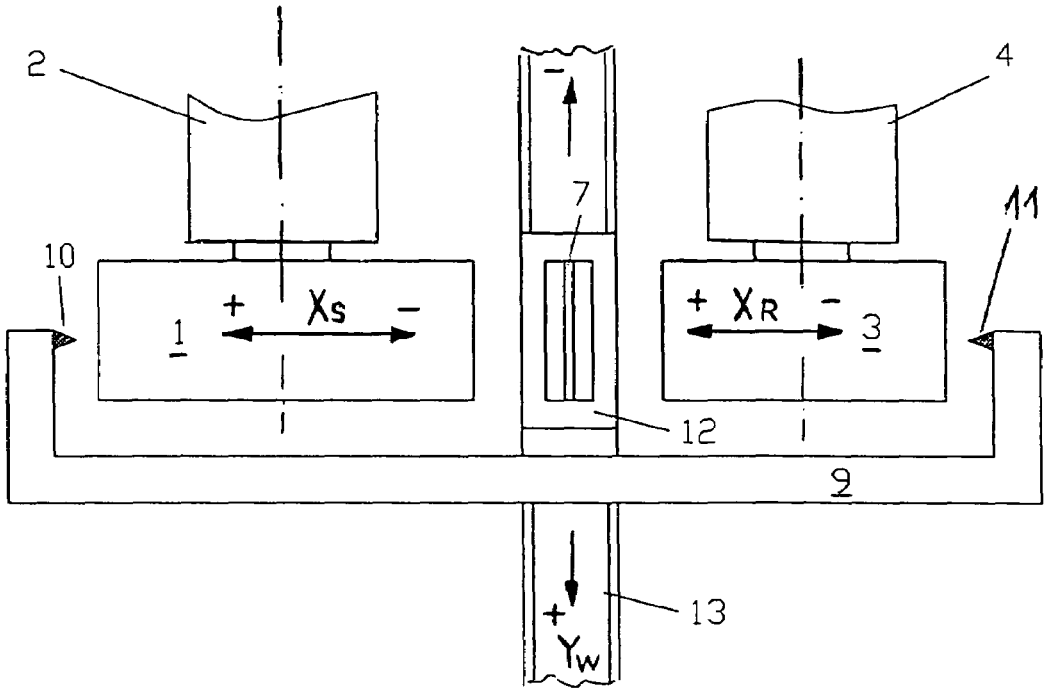
FIG. 1*a* is a diagram of the arrangement of the positioning axes as well as the workpiece support, the grinding wheel and the regulating wheel and outer-acting dressers.
Figure 2:
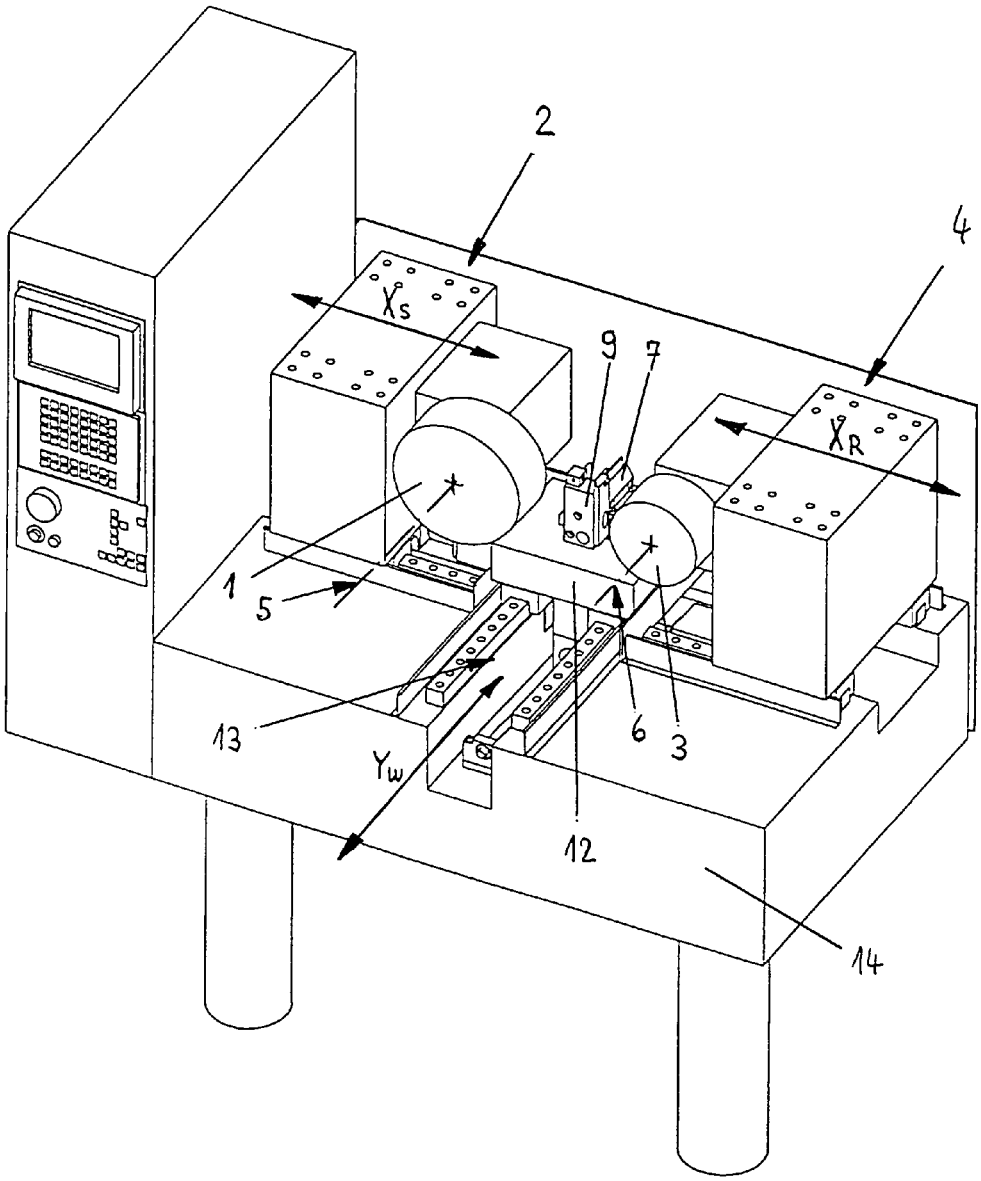
FIG. 2 is a perspective view of a centreless cylindrical grinding machine with inner-acting dressers without the safety housing.

FIGS. 1, 1*a* and 2 show the principal arrangement of the moving parts of a centreless cylindrical grinding machine according to the present invention. FIGS. 1 and 1*a* illustrate only the difference in using inner- or outer-acting means for truing. FIG. 2 is a perspective view.

A grinding wheel 1 on a grinding spindle head 2 can be moved in a first driven positioning axis $X_S$. A regulating wheel 3 on a regulating spindle head 4 can be moved in a second driven positioning axis $X_R$. The positioning axis $X_S$ here runs parallel to the positioning axis $X_R$. The positioning axes $X_S$ and $X_R$ are arranged at right angles to each of the rotating axes 5, 6 of the grinding wheel 1 and the regulating wheel 3. Disposed between the grinding spindle head 2 and the regulating spindle head 4 is a workpiece support 7 for a workpiece 8. The workpiece support 7 and a wheel-true device 9, which comprise a first dresser 10 for the grinding wheel 1 and a second dresser 11 for the regulating wheel 3, are situated on a carriage 12 which can be moved in a carriage track 13 at a right angle to the axes $X_S$ and $X_R$ in a driven positioning axis $Y_W$. By means of the carriage 12 the workpiece support 7 and the wheel-true device 9 can move out of the danger zone of the grinding wheel 1 and the regulating wheel 3. Thereby the wheel-true device 9 can be equipped with inner-acting dressers 10, 11 as per FIG. 1 or with outer-acting dressers 10, 11 as per FIG. 1*a*. FIG. 2 likewise shows a wheel-true device 9 with inner-acting dressers. By use of suitable structural measures (holding brackets and the like, known to the expert and accordingly not explained in any greater detail here) various dressers 10, 11 for truing the grinding wheel 1 and regulating wheel 3 can be fastened selectively on the wheel-true device 9.

A coolant supply can also be attached on the carriage 12 (not illustrated).

The grinding spindle head 2, the regulating spindle head 4 and the carriage 12 on the carriage track 13 are preferably constructed on a machine bed 14 made of thermostable natural granite.

Figure 3:
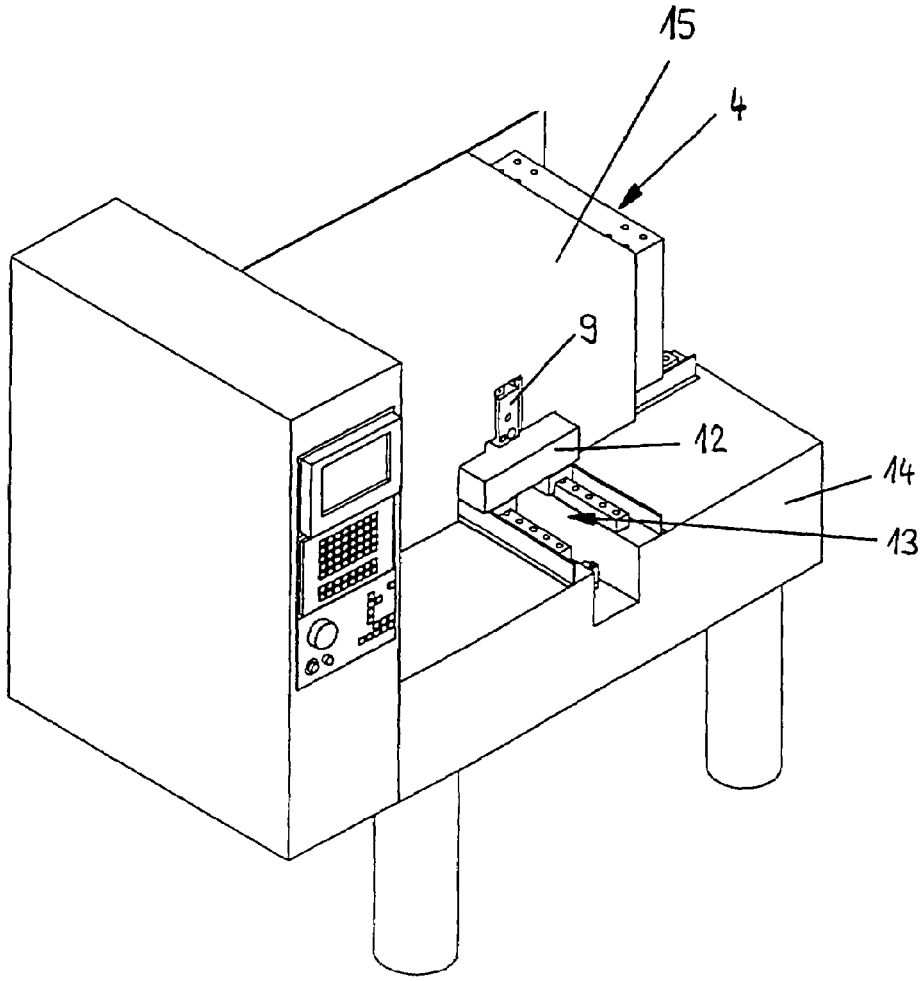
FIG. 3 is a perspective view of the centreless cylindrical grinding machine according to FIG. 2 with closed safety housing and the carriage with the workpiece support inside the safety space.

FIG. 3 is a perspective view of the centreless cylindrical grinding machine with a closed safety housing 15 and with the carriage 12 inside a safety space, formed by the safety housing 15. The carriage is in a working position here, though it is evident that the carriage 12 can be moved on the carriage track 13 into a position lying outside the safety housing 15.

Figure 4:
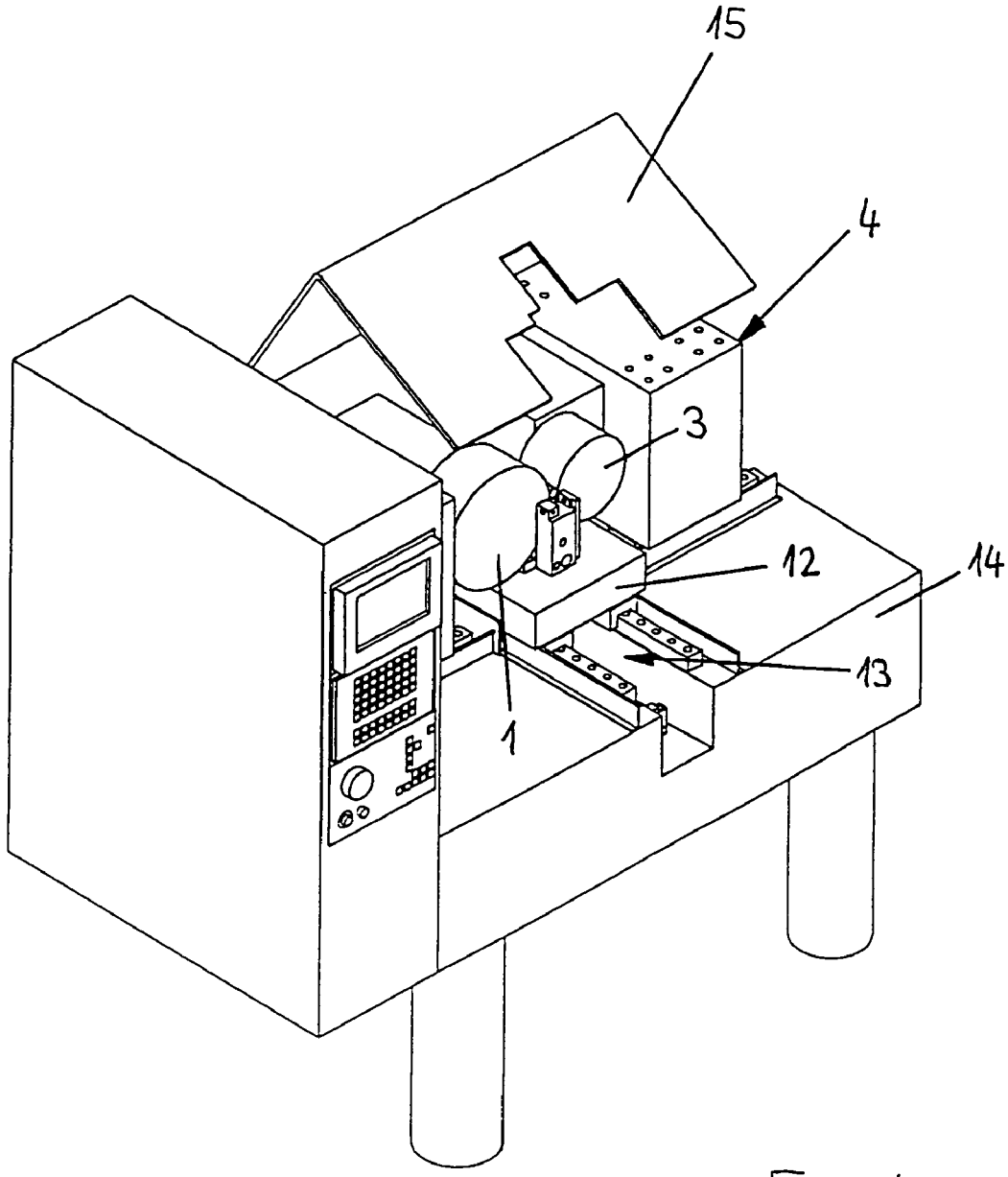
FIG. 4 is a perspective view of the centreless cylindrical grinding machine according to FIG. 2 with raised safety housing and the carriage with the workpiece support inside the safety space.

FIG. 4 gives substantially the same view as FIG. 3, though with raised safety housing 15.

Figure 5:
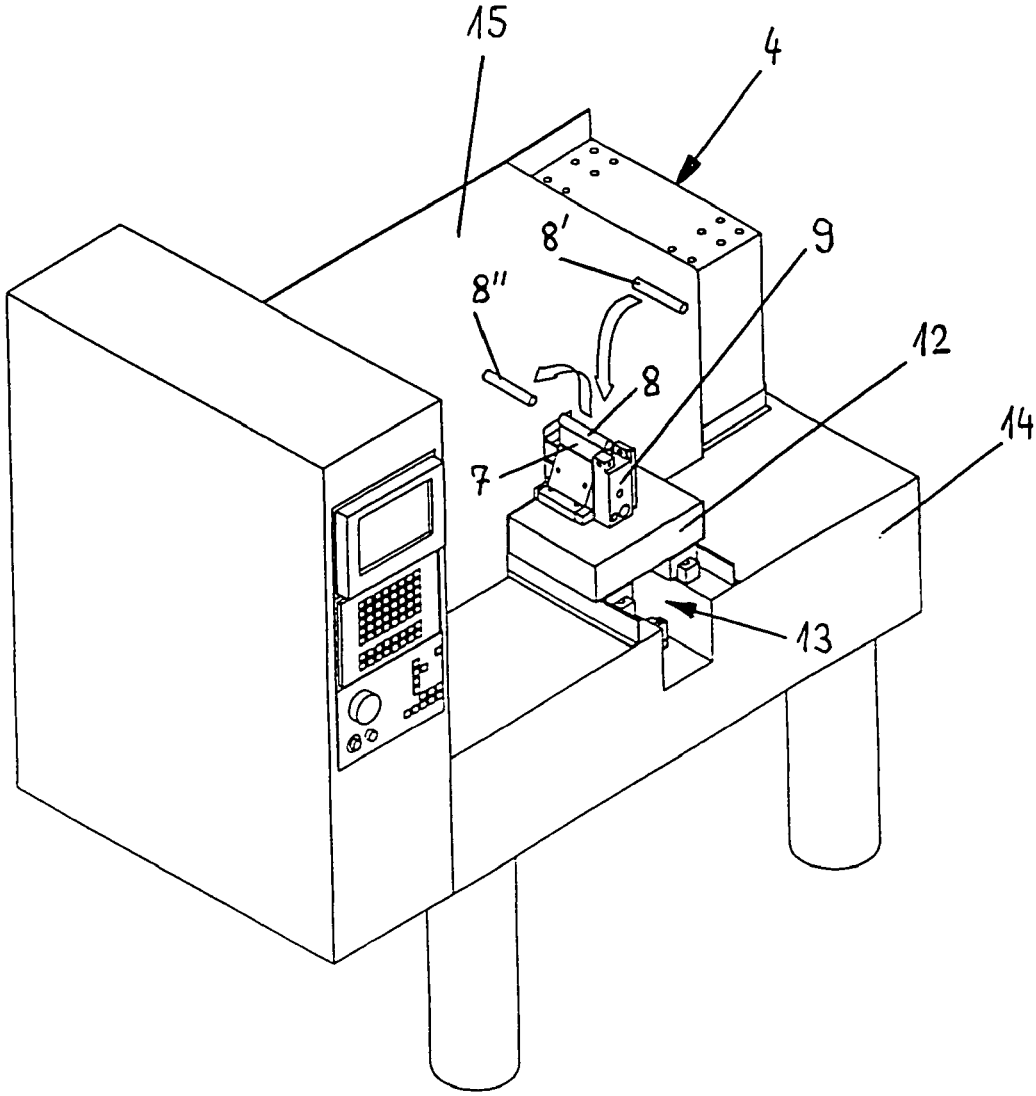
FIG. 5 is a perspective view of the centreless cylindrical grinding machine according to FIG. 2 with closed safety housing and the carriage with the workpiece support in fitting position outside the safety space.

FIG. 5 finally is a perspective view of the centreless cylindrical grinding machine with closed safety housing 15 and the carriage 12 with the workpiece support 7, the workpiece 8 and the wheel-true device 9 in "fitting position" outside the safety space. "Loading" is indicated schematically with a new workpiece 8' or "unloading" of a processed workpiece 8".

Figure 6:
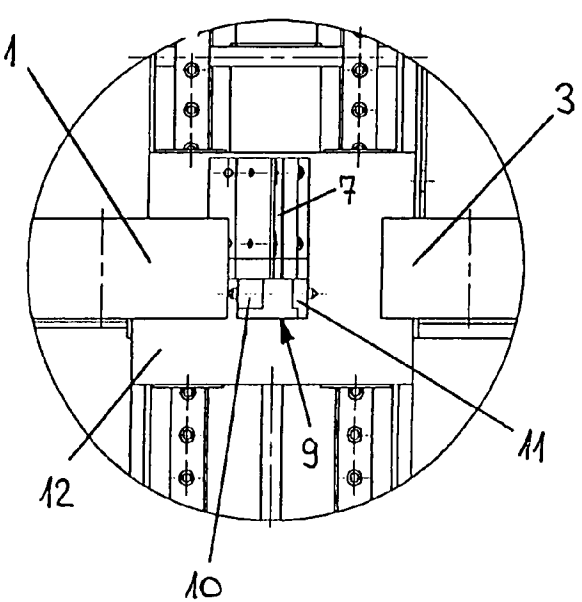
FIG. 6 is a perspective view of the centreless cylindrical grinding machine according to FIG. 2 without the safety housing as well as a diagrammatic illustration in the position when the grinding wheel is being trued.
Figure 6:
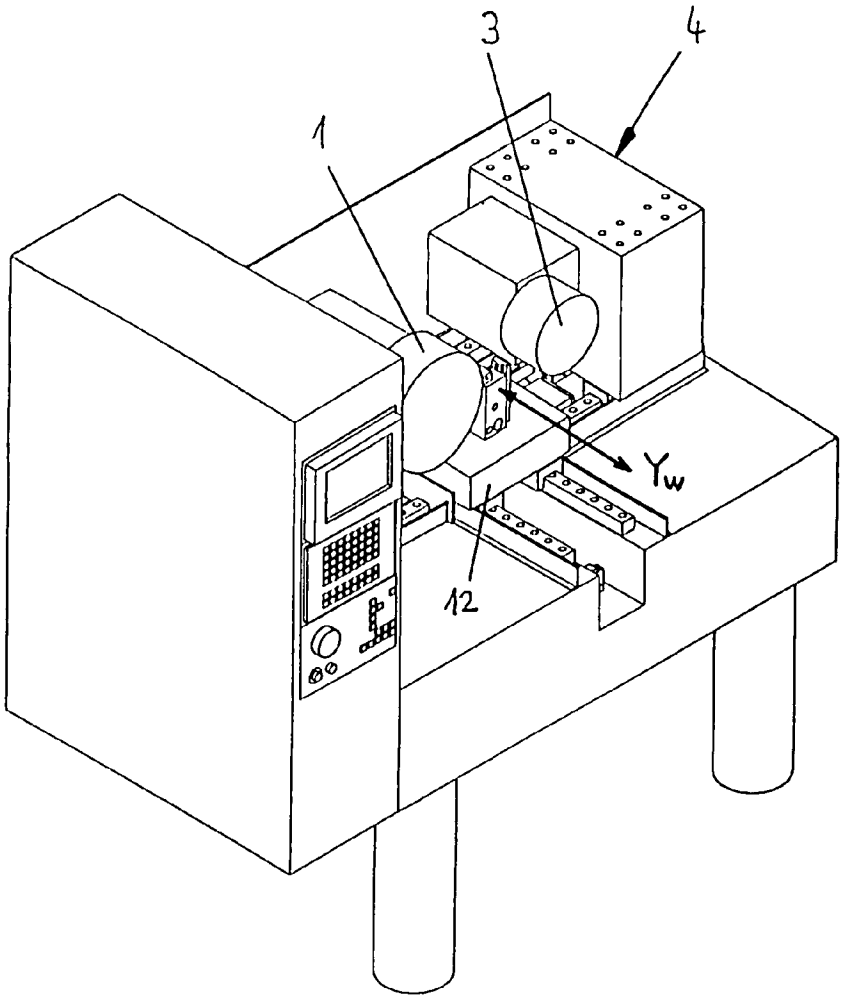
Figure 7:
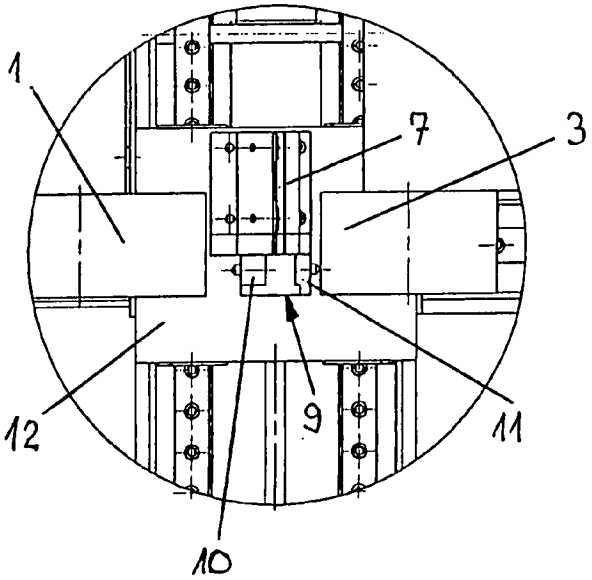
FIG. 7 is a perspective view of the centreless cylindrical grinding machine according to FIG. 2 without the safety housing as well as a diagrammatic illustration in the position when the regulating wheel is being trued.
Figure 7:
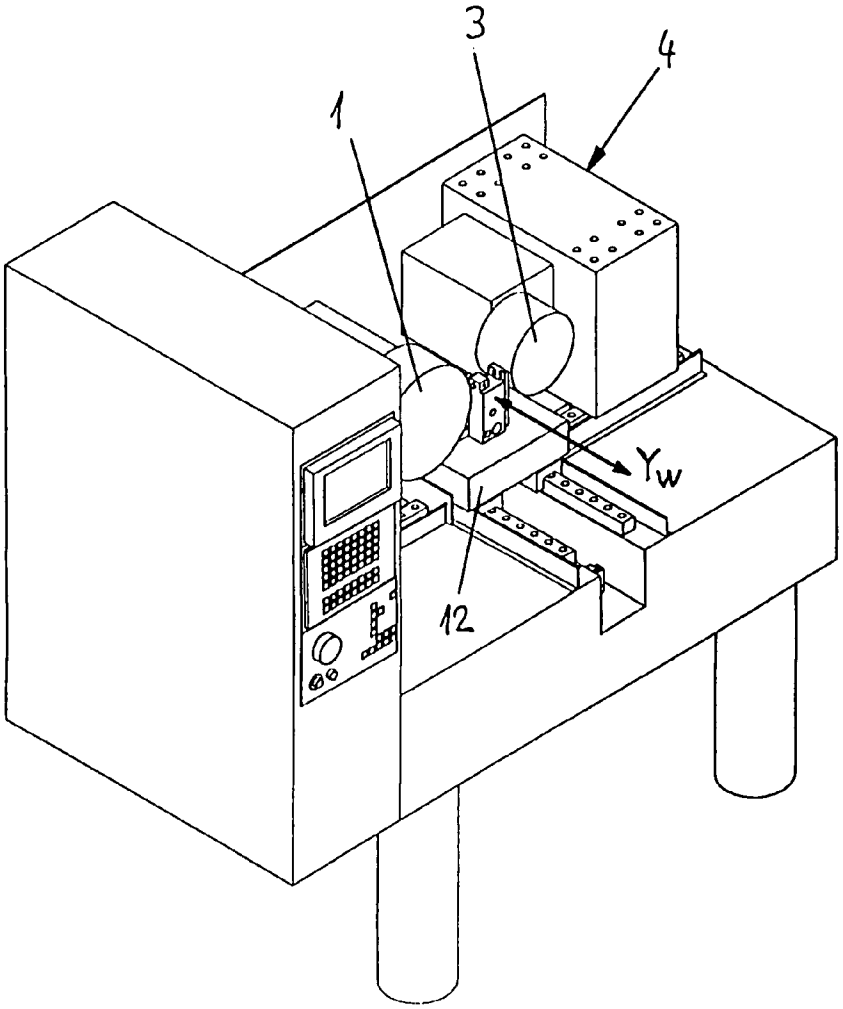

FIGS. 6 and 7 schematically represent the positions when the grinding wheel 1 is trued (FIG. 6) or when the regulating wheel 3 is trued (FIG. 7). For the sake of clarity the illustration omits the safety housing 15.

When the grinding wheel 1 is trued (cf. FIG. 6, enlarged detail) the first dresser 10 for the grinding wheel is in contact with the grinding wheel 1. For this the carriage 12 is positioned with the attached workpiece support 7 and the wheel-true device 9 in a direction in front of the grinding wheel 1 and the latter are advanced. By shifting the dresser 10 in $Y_W$ direction and optionally by simultaneously shifting the grinding wheel 1 in $X_S$ direction various contours can be defined or trued on the grinding wheel 1.

When the regulating wheel 3 is trued (cf. FIG. 7, enlarged detail) the second dresser 11 for the regulating wheel is in contact with the regulating wheel 3. By shifting the dresser 11 in $Y_W$ direction and optionally by simultaneously shifting the regulating wheel 3 in $X_R$ various contours can be defined or trued on the regulating wheel 3.

The wheel-true device 9 can (depending on demand) be selectively fitted with a wide range of dressers for truing the grinding wheel 1 or the regulating wheel 3. This may be truing diamonds, diamond shaping rollers, diamond profile rollers, tiles or similarly acting truing contrivances. The wheel-true device 9 is provided for easy exchange and selective provision with such truing contrivances. These truing contrivances can be brought to use both as first dresser 10 for the grinding wheel 1 and also as second dresser 11 for the regulating wheel 3, as required.

The already mentioned option of moving the carriage 12 in the $Y_W$ direction, opens up new forms of processing workpieces 8. Thus the drive for the positioning axis $Y_W$ of the carriage 12 can be formed such that oscillating movements can be generated. With oscillating movements of the workpiece 8 during the grinding procedure (only for in-feed grinding) improved roughness values can be achieved for the ground surfaces.

One or more shoulders can be ground into the workpiece 8 through the additional option of moving not only the carriage 12 in the $Y_W$ direction, but at the same time also moving the grinding wheel 1 in the $X_S$ direction. Preferably, all drives or at least the drives for the positioning axes $X_S$ and $Y_W$ of the centreless cylindrical grinding machine according to the present invention are formed such that simultaneous movements and movement sequences in the X and Y directions can occur. Thereby the grinding wheel 1 with respect to its rotating axis 5 can be arranged axis-parallel or at an angle to the rotating axis 6 of the regulating wheel 3.

Figure 1B:
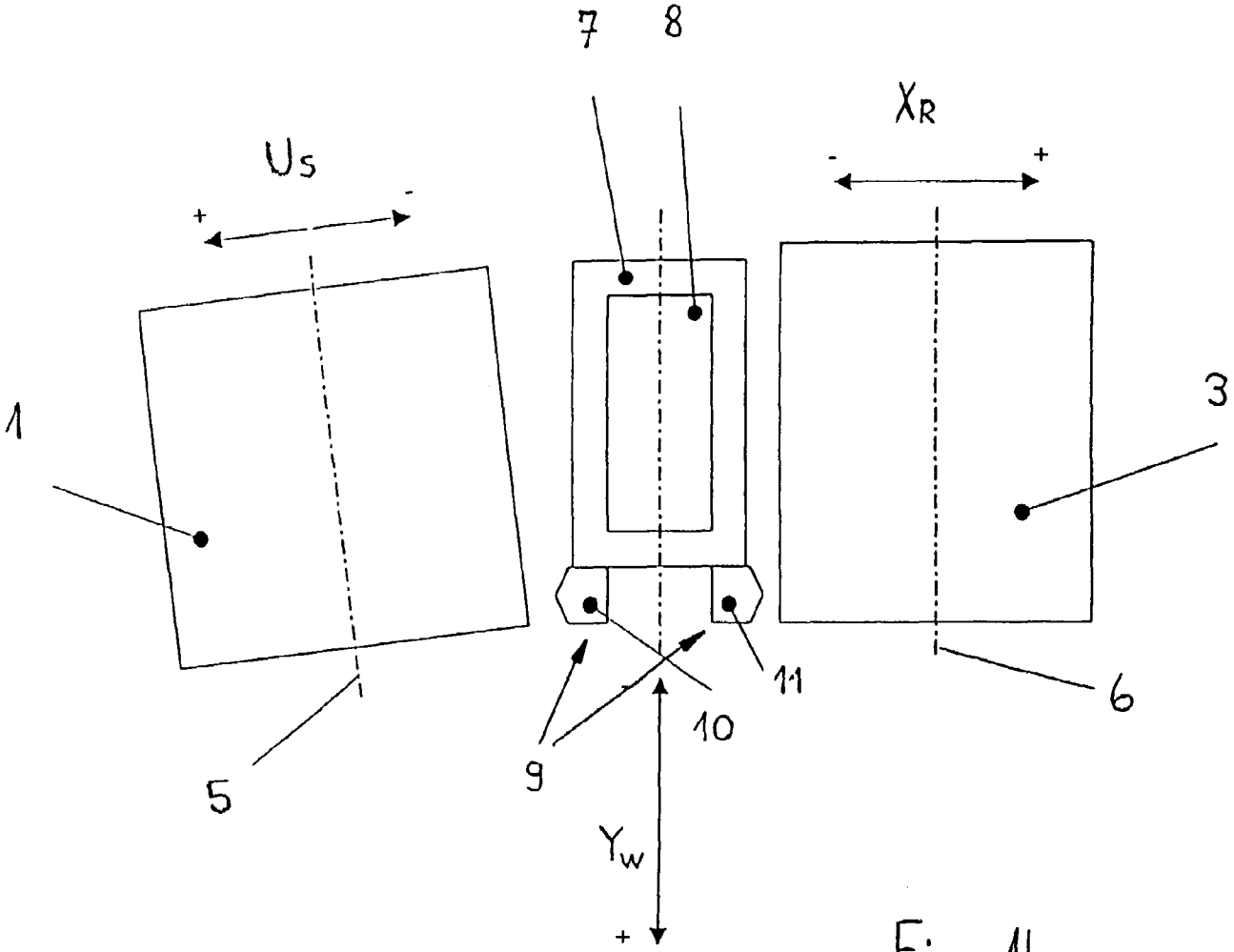
FIG. 1*b* is a diagram of the arrangement of the positioning axes as well as the workpiece support, the grinding wheel and the regulating wheel and inner-acting dressers according to an exemplary embodiment of the invention.

With respect to arrangement of the positioning axes finally there is also the option that those of the grinding spindle heads 2 can be positioned at an incline with respect to those of the regulating spindle head 4 (see, for example, FIG. 1*b*). For better clarity with respect to the above described arrangements the designation positioning axis $U_S$ is used for the grinding spindle head 2 and positioning axis $X_R$ is used for the regulating spindle head 4. With such machine construction the rotating axis 5 of the grinding wheel 1 can be arranged at a right angle to the positioning axis $U_S$ for the grinding spindle head; but it must not be. Normally, with such machine construction the positioning axis $X_R$ is also arranged at right angles to the rotating axis (6) of the regulating wheel (3) and the positioning axis $Y_W$ is arranged at right angles to the positioning axis $X_R$. Also in the case of a machine construction with positioning axis $U_S$ inclined relative to the positioning axis $X_R$, both a wheel-true device 9 with inner-acting dressers 10, 11 and a wheel-true device 9 with outer-acting dressers 10, 11 can be used.

Figure 8A:
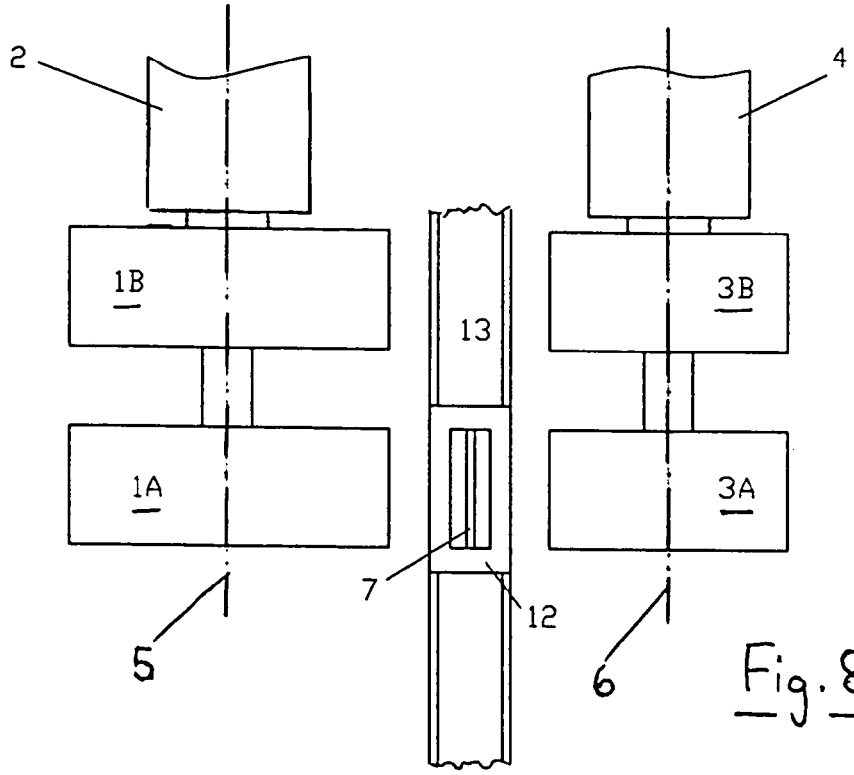
FIG. 8*a* is an illustration of a grinding wheel and a regulating wheel with partial grinding wheels and partial regulating wheels in readiness for a first grinding operation.
Figure 8B:
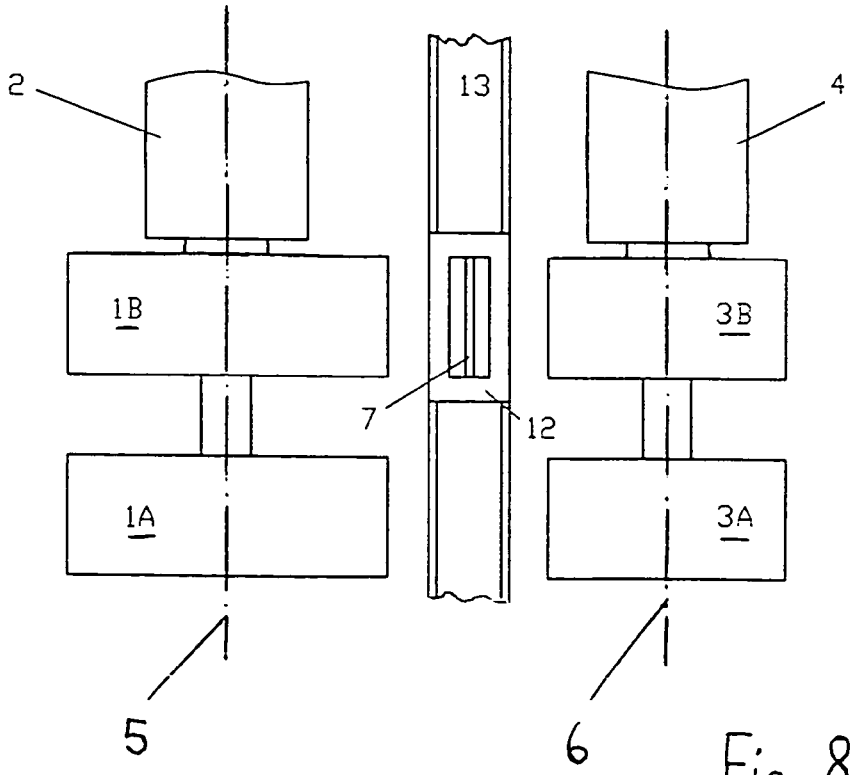
FIG. 8*b* is an illustration according to FIG. 8*a* in readiness for a second grinding operation.

Finally, FIGS. 8*a* and 8*b* illustrate a grinding wheel 1, comprising two partial grinding wheels 1A and 1B arranged successively on the rotating axis 5 and a regulating wheel 3, consisting of two partial regulating wheels 3A and 3B arranged successively on the axis of rotation 6. FIG. 8*a* shows the carriage 12 with the workpiece support 7 in a first position at the level of the partial grinding wheel 1A and the partial regulating wheel 3A, which corresponds to a readiness position for a first grinding operation. FIG. 8*b* shows the carriage 12 with the workpiece support 7 in a second position at the level of the partial grinding wheel 1B and the partial regulating wheel 3B, which corresponds to a readiness position for a second grinding operation. Other partial grinding wheels and partial regulating wheels may also be present. Simple shifting of the carriage 12 results in two or also more grinding operations being possible time-consuming loading, unloading and changing operations for a workpiece. The grinding wheel and the regulating wheel can (as shown) be added as several partial wheels arranged separate from one another. But it is also possible to profile full wheels through different kinds of adjacent partial sections, with the same aim being achieved.

The total of the measures disclosed above allows centreless cylindrical grinding machines to be made not only more simply and accordingly less expensively, but also safer in handling and substantially more flexible and faster in retooling and changing.

LEGEND

| | |
|---|---|
| 1 | grinding wheel |
| 1A, 1B | partial grinding wheels |
| 2 | grinding spindle head |
| 3 | regulating wheel |
| 3A, 3B | partial regulating wheels |
| 4 | regulating spindle head |
| 5 | rotating axis of grinding wheel |
| 6 | rotating axis of regulating wheel |
| 7 | workpiece support |
| 8 | workpiece |
| 9 | wheel-true device |
| 10 | first dresser (for grinding wheel) |
| 11 | second dresser (for regulating wheel) |
| 12 | carriage |
| 13 | carriage track |
| 14 | machine bed |
| 15 | safety housing |
| $X_S$ | positioning axis for grinding wheel |
| $U_S$ | positioning axis for grinding wheel |
| $X_R$ | positioning axis for regulating wheel |
| $Y_W$ | positioning axis for carriage (workpiece support) |

The invention claimed is:

1. A centreless cylindrical grinding machine for through-feed and in-feed grinding of various workpieces, the centreless cylindrical grinding machine comprising:

a first driven positioning axis $X_S$ for a grinding spindle head with a grinding wheel;

a second driven positioning axis $X_R$ running parallel to the positioning axis $X_S$ for a regulating spindle head with a regulating wheel, whereby the positioning axes $X_S$ and $X_R$ are arranged at right angles to rotating axes of the grinding wheel and the regulating wheel; and a workpiece support arranged substantially between the grinding spindle head and the regulating spindle head, whereby another positioning axis $Y_W$ for a carriage driven and running at right angles to the positioning axes $X_S$ and $X_R$ is present on a carriage track and the workpiece support is placed on the carriage, the centreless cylindrical grinding machine further comprising a drive for the positioning axis $Y_W$ of the carriage adapted to generate oscillating movements, wherein the grinding spindle head, the regulating spindle head, the workpiece support and a wheel-true device are arranged inside a safety housing, whereby the carriage on the carriage track is movable into a position lying outside the safety housing, and whereby the carriage is adapted to be selectively fitted with the wheel-true device, the wheel-true device being an inner-acting dresser or an outer-acting dresser, the wheel-true device further including a truing contrivance for the grinding wheel and a truing contrivance for the regulating wheel.

2. The centreless cylindrical grinding machine as claimed in claim 1, wherein the grinding spindle head, the regulating spindle head and the carriage in the carriage track are built on a machine bed made of thermostable natural granite.

3. The centreless cylindrical grinding machine as claimed in claim 1, wherein the grinding spindle head with the grinding wheel is movable in the positioning axis $X_S$ and the workpiece support with the workpiece is simultaneously movable in the positioning axis $Y_W$ in order to grind one or more shoulders on the workpiece.

4. The centreless cylindrical grinding machine as claimed in claim 3, wherein a rotating axis of the grinding wheel is arranged parallel to or at an angle to the rotating axis of the regulating wheel.

5. The centreless cylindrical grinding machine as claimed in claim 1, wherein the grinding wheel comprises several partial grinding wheels arranged successively on a rotating axis of the grinding wheel; and the regulating wheel comprises several partial regulating wheels arranged successively on a rotating axis of the regulating wheel.

6. A centreless cylindrical grinding machine for through-feed and in-feed grinding of various workpieces, the centreless cylindrical grinding machine comprising:

a first driven positioning axis $U_S$ for a grinding spindle head with a grinding wheel;

a second driven positioning axis $X_R$ inclined to the positioning axis $U_S$ for a regulating spindle head with a regulating wheel, whereby the positioning axis $U_S$ is adapted to be arranged at a right angle to a rotating axis of the grinding wheel and the positioning axis $X_R$ is arranged at a right angle to a rotating axis of the regulating wheel; and a workpiece support arranged substantially between grinding spindle head and regulating spindle head, whereby another driven positioning axis $Y_W$ running at right angles to the positioning axis $X_R$ is present for a carriage on a carriage track and the workpiece support is placed on the carriage, the centreless cylindrical grinding machine further comprising a drive for the driven axis $Y_W$ of the carriage adapted to generate oscillating movements, wherein the grinding spindle head, the regulating spindle head, the workpiece support and a wheel-true device are arranged inside a safety housing, whereby the carriage is movable on the carriage track into a position lying outside the safety housing, and whereby the carriage is adapted to be selectively fitted with the wheel-true device, the wheel-true device being an inner-acting dresser or an outer-acting dresser, the wheel-true device further including a truing contrivance for the grinding wheel and a truing contrivance for the regulating wheel.

7. The centreless cylindrical grinding machine as claimed in claim 1, wherein the wheel-true contrivance for the grinding wheel is a diamond.

8. The centreless cylindrical grinding machine as claimed in claim 1, wherein the wheel-true contrivance for the regulating wheel is a diamond.

9. The centreless cylindrical grinding machine as claimed in claim 1, wherein the wheel-true device is adapted to be selectively fitted with the wheel-true contrivance.

10. A centreless cylindrical grinding machine for through-feed and in-feed grinding of various workpieces, the centreless cylindrical grinding machine comprising:

a grinding wheel having a rotating axis, the grinding wheel adapted to be rotatably driven by a grinding spindle head, the grinding wheel and the grinding spindle head being selectively positionable along a first driven positioning axis $X_S$;

a regulating wheel having a rotating axis, the regulating wheel adapted to be rotatably driven by a regulating spindle head, the regulating wheel and the regulating spindle head being selectively positionable along a second driven positioning axis $X_R$ running approximately parallel to the positioning axis $X_S$;

the positioning axes $X_S$ and $X_R$ being arranged at angles to the rotating axis of the grinding wheel and the rotating axis of the regulating wheel;

a carriage movably disposed on a carriage track extending along a driven positioning axis $Y_w$, the driven positioning axis $Y_W$ being substantially arranged between the grinding spindle head and the regulating spindle head and disposed at substantially right angles to the positioning axes $X_S$ and $X^R$;

a workpiece support coupled to the carriage;

a wheel-true device including an inner-acting dresser or an outer-acting dresser, the wheel-true device further adapted to be selectively fitted on the carriage; and a safety housing, the safety housing adapted to receive the grinding wheel, the grinding spindle head, the regulating wheel, the regulating spindle head, the carriage, the workpiece support and the wheel-true device therein, and wherein the carriage is movable to a position outside of the safety housing without manipulating the safety housing.

* * * * *